US005457822A

United States Patent [19]

Klammsteiner

[11] Patent Number: 5,457,822

[45] Date of Patent: Oct. 17, 1995

[54] DEVICE FOR DISPENSING DISINFECTANT, CLEANING AGENT AND/OR SCENT INTO A TOILET BOWL

[75] Inventor: Karl Klammsteiner, Rankweil, Austria

[73] Assignee: Kuyus Stiftung, Liechtenstein

[21] Appl. No.: 190,092

[22] PCT Filed: Jul. 24, 1992

[86] PCT No.: PCT/EP92/01692

§ 371 Date: Jan. 31, 1994

§ 102(e) Date: Jan. 31, 1994

[87] PCT Pub. No.: WO93/03232

PCT Pub. Date: Feb. 18, 1993

[30] Foreign Application Priority Data

Jul. 30, 1991 [CH] Switzerland ..... 2271/91

[51] Int. Cl.[6] ..... E03D 9/02

[52] U.S. Cl. ..... 4/223; 4/231

[58] Field of Search ..... 4/222, 223, 231

[56] References Cited

U.S. PATENT DOCUMENTS

| | | | |
|---|---|---|---|
| 1,070,681 | 8/1913 | Goodhue | 4/223 |
| 2,444,441 | 7/1948 | Grinham | 4/223 |
| 2,760,209 | 8/1956 | Ewing . | |
| 3,336,603 | 8/1967 | Leland . | |
| 3,420,445 | 1/1969 | Inzerill | 4/223 |
| 3,953,902 | 5/1976 | Taylor . | |
| 4,183,105 | 1/1980 | Womack . | |
| 4,670,916 | 6/1987 | Bloom . | |

FOREIGN PATENT DOCUMENTS

| | | | |
|---|---|---|---|
| 2498656 | 7/1982 | France . | |
| 1609234 | 2/1971 | Germany . | |
| 0088828 | 3/1990 | Japan | 4/223 |

*Primary Examiner*—Charles E. Phillips
*Attorney, Agent, or Firm*—Ostrolenk, Faber, Gerb & Soffen

[57] ABSTRACT

A device for dispensing a disinfectant, cleaning agent and/or scent into the interior of a toilet bowl includes a reservoir for the disinfectant, cleaning agent and/or scent. The reservoir has suspension elements fitted to the rim of the bowl or the outside of the bowl and a feed line passing over the rim and into the interior of the bowl. A dispenser element is fitted to the feed line in the interior of the bowl for dispensing a given quantity of the disinfectant, cleaning agent and/or scent into the interior of the bowl. An actuator is fitted to the reservoir, the feed line or the dispenser element and operated by the user of the toilet bowl to dispense a given quantity of disinfectant, cleaning agent and/or scent. The feed line has at least one non-return valve for preventing the disinfectant, cleaning agent and/or scent from flowing back into the reservoir.

16 Claims, 6 Drawing Sheets

DEVICE FOR DISPENSING DISINFECTANT, CLEANING AGENT AND/OR SCENT INTO A TOILET BOWL

BACKGROUND OF THE INVENTION

1. Field of the Invention

The present invention concerns a device for dispensing a disinfectant and/or a cleaning agent or a scent into a WC or toilet bowl, and a process for disinfecting and/or cleaning a toilet bowl using such a device.

2. Description of Related Art

Maintaining clean and hygienic conditions in toilets and in toilet facilities, especially the toilet bowl, is a constant problem. Scent treatments have been developed for this purpose, but they only address one part of the problem.

It is indeed possible to take precautionary measures with newly installed or built toilet facilities, by installing ventilation systems, building in special flushing systems in the toilet bowl etc., but their efficiency is not fully satisfactory, or their effect is delayed, as for example with odor removal.

In addition, there is a desire to improve the cleanliness of toilet bowls and reduce odor build-up, even in already existing toilet facilities, where for example the bowl is cleaned by a so-called toilet scrubber, and disinfectant or deodorant agents are added to the flushwater in containers. In other words, these are all improvised measures, that come into effect only after the toilet has been used.

In the current state of the art, two patents are known, U.S. Pat. No. 2,760,209 and DE-OS 16 09 234, each of which discloses a device for introducing a liquid disinfectant and/or deodorant into a toilet bowl. In each of these patents, a pouch-like container is located over the rim of the bowl and is squeezed by downward pressure on the toilet seat. The increasing pressure causes the liquid to be released through a tube into the inside of the toilet bowl. Both devices have the disadvantage that when the pressure is released or lifted from the toilet seat, pressure is equalized by the return flow of air through the tube or conveying channel that must at the same time serve to feed the liquid into the inside of the toilet bowl. In addition, inside the pouch-like device or in the portion of the device running under the seat, mechanisms must be provided that will cause the air to expand or be sucked back. It is also a feature of the above devices that at the beginning, when the container is full, a great deal of liquid is sprayed into the toilet bowl, while, when the container is almost empty, very little liquid is released into the bowl.

In U.S. Pat. No. 670,916 a dispenser is described whereby liquid is released into a conduit tube when pressure is applied to a nozzle located above, and this conduit tube extends over the upper rim of the toilet into the interior of the bowl. At the end of this tube a balloon is affixed, where the liquid is temporarily stored. A deodorant or disinfectant is then released drop by drop from this balloon over a longer period of time, for the purpose of preventing odor accumulation in the toilet bowl over a longer period of time. The disadvantage of the device as proposed in U.S. Pat. No. 4,670,916, especially in FIG. 4, lies in the fact that, while a deodorant or disinfectant may indeed be released over a longer period of time, this will still be occurring during times when the toilet is not in use at all. And yet, the efficiency of this device is insufficient to overcome or prevent strong odors or soiling when the toilet is being used.

SUMMARY OF THE INVENTION

Thus, the purpose of the present invention is to provide a device which can be used even in existing toilet installations to meet the demand for cleanliness and odor removal, better and more efficiently than do those described above. In addition, the present invention is intended to provide a device that is as simple as possible, even for existing installations, and easy to refill.

With particular reference to the production of odors the invention presents the advantage that odors are neutralized right at the point where they occur. Since, for example, a scent is introduced before the odor arises, then the odor will no longer be noticeable.

A process for disinfecting and/or cleansing a toilet bowl is further provided, using a device corresponding to the invention.

The invention is explained below in greater detail with reference to the accompanying illustrations.

DETAILED DESCRIPTION OF THE PREFERRED EMBODIMENT

Figure 1:
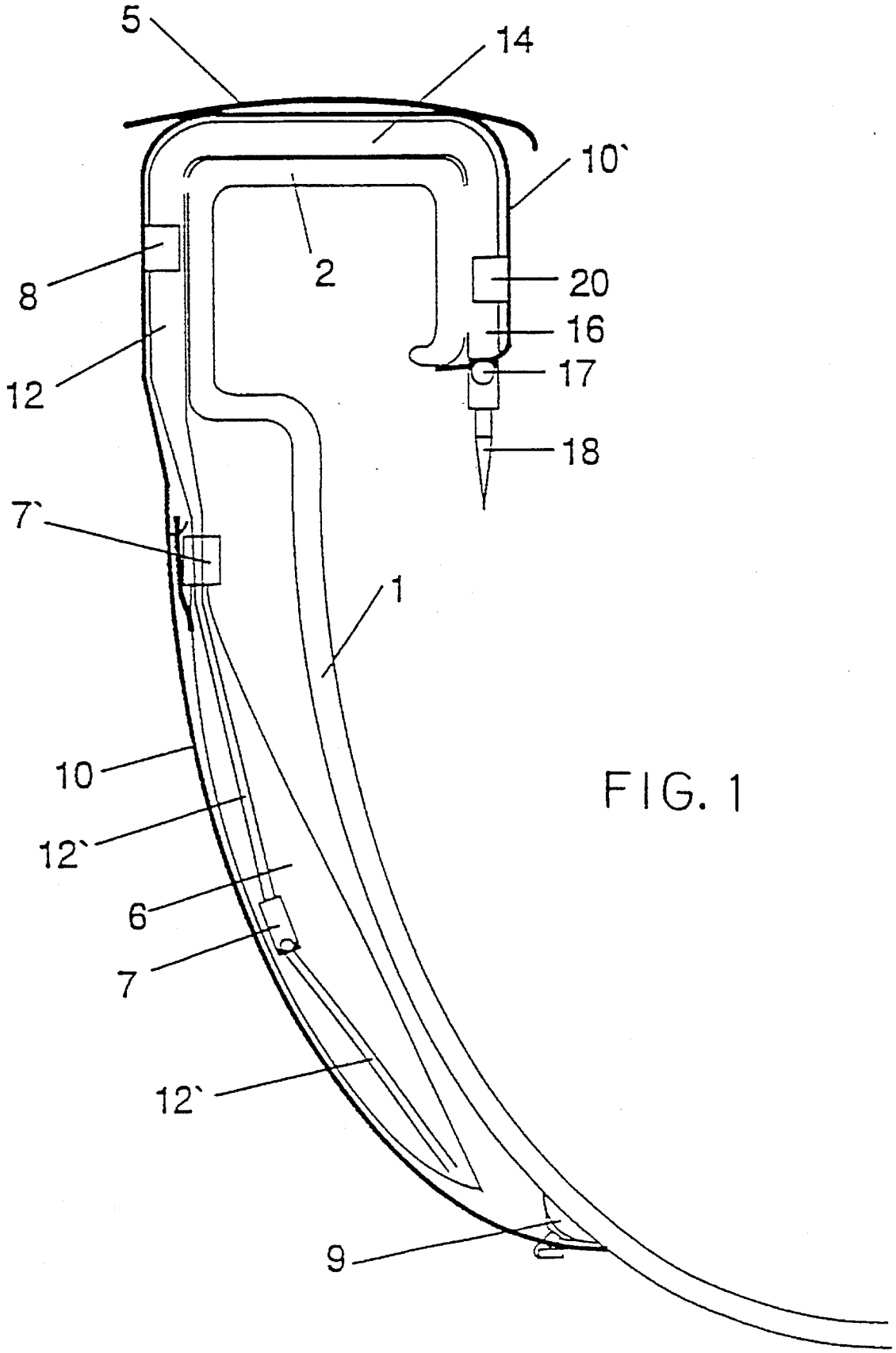
FIG. 1 is a cross-section of a device in accordance with the invention, installed on a toilet bowl.

Referring to FIG. 1, the outer wall of the toilet bowl 1 having an upper rim 2, a container 6 is suspended, containing a disinfectant and/or cleaning agent, as, well as an additional aroma or scent. It is also possible to add a decalcifying agent. The container 6 is arranged so that it lies or hangs in a plastic cover 10, that in turn is affixed to the toilet bowl by means of a suction cup 9 at its lower end and a bracket 10' at its upper end. The container, however, can also be installed at a distance from the toilet bowl, for example on the wall of the toilet cubicle, directly next to the toilet bowl. The bracket 10' attached above to the plastic cover 10 in this case extends over the upper rim 2 of the toilet bowl so that the cover 10 is hooked over the upper rim 2 of the bowl.

A feed line 12 extends from an upper opening 7' in the container 6 along the underside of the plastic cover 10 over a section 14 which runs essentially underneath the toilet seat 5 to a section 16 of the feed line, whereby the feed line is fastened to the cover 10 or 10' by means of clamps 8 and 20. At the end of the liquid feed line 16 is affixed a dispensing device 18, such as for example a sprinkling or spraying mechanism equipped with a non-return or one-way valve 17.

On the other side, the feed line 12 extends through the container opening 7' into the inside of the reservoir 6 through what is preferably an essentially rigid section of piping 12', which is also equipped with a non-return valve 7.

Figure 2:
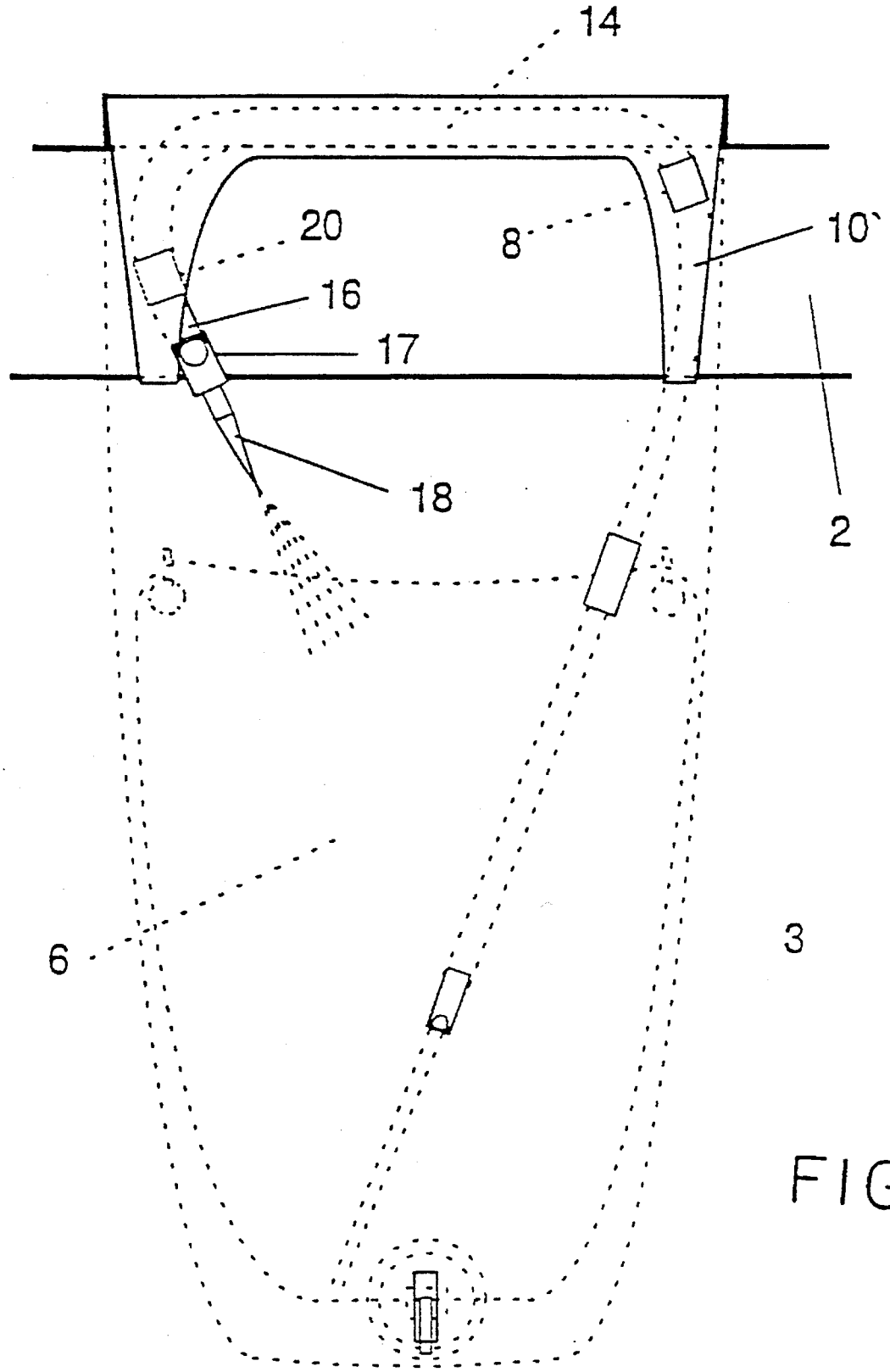
FIG. 2 is a top view of the device shown in FIG. 1 from inside the toilet bowl.

In FIG. 2 the device according to FIG. 1 is shown in a top view from inside the toilet bowl, so that essentially only the inner surface 3 of the toilet bowl is visible, along with the upper rim 2 of the bowl with the inwardly suspended portion of the cover 10', by means of which the cover 10 itself is secured on the outer side of the toilet bowl. Inside the bowl, the spray or sprinkling nozzle 18 with its non-return valve 17 is also clearly visible. Depending on the arrangement of the cover 10', items 16, 17 and 18 may also be concealed.

All the remaining parts of the device either lie under the cover 10' or are arranged outside the toilet bowl, so that they are shown only with dotted lines.

Figure 3:
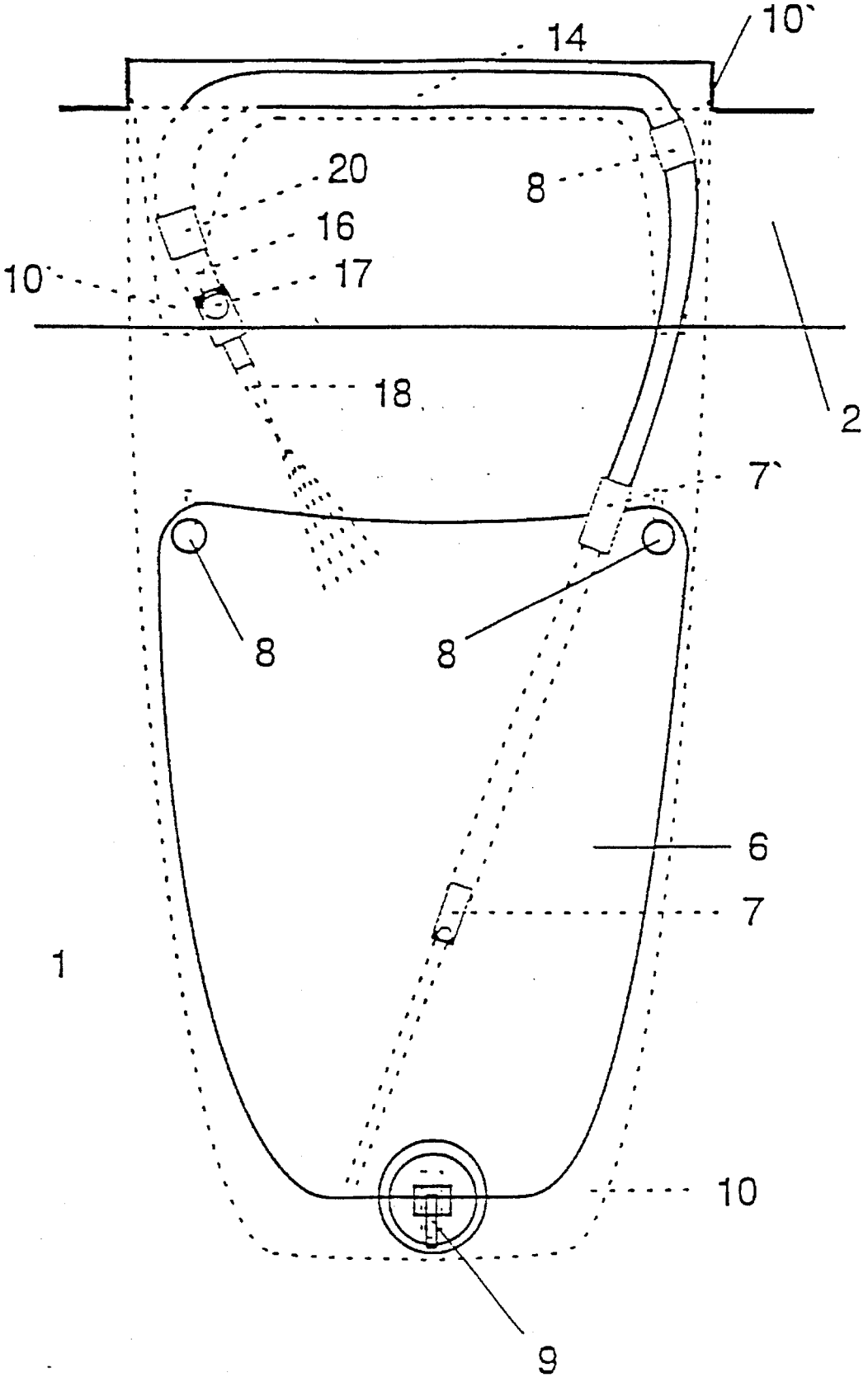
FIG. 3 is a top view of the devices shown in FIGS. 1 and 2 from the exterior of the toilet bowl.

In FIG. 3, the device in accordance with the invention as shown in FIG. 1 is seen from the outer side of the toilet bowl, with the cover 10 not shown, so that the parts of the device are visible. The container 6 with the cleansing or disinfectant liquid can also be secured with overhead hooks and eyelets on the inner side of the cover 10, whereby the suction cup 9 is provided below and also serves to secure the cover 10.

Figure 4:
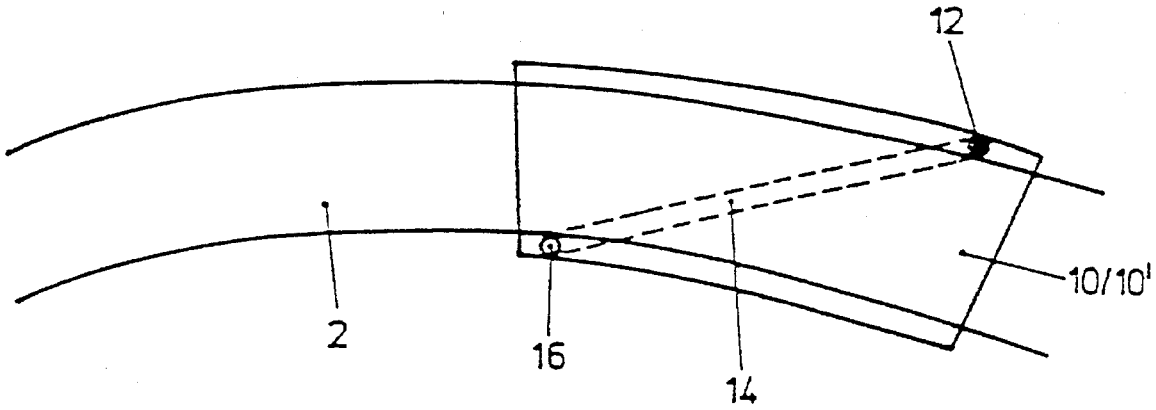
FIG. 4 shows the activating mechanism of the device in accordance with FIGS. 1 to 3, seen from above on the toilet bowl rim.

In FIG. 4, a section 14 of the tube running underneath the cover 10 or 10' is shown, seen on the rim 2 of the toilet bowl. The tube section 14 is shown in dotted lines, since it is concealed by the cover 10 or 10'.

If a person using the toilet now sits down on the seat 5, the section 14 of the liquid feed line is squeezed, so that the two non-return valves 7 and 17 force the liquid in the tube in the direction of the sprinkling nozzle 18, and a dose of the liquid is sprinkled into the interior 3 of the bowl. In this way the device is activated before the toilet is actually used.

In the first place, the liquid spray contains a film-forming lubricant or a cleansing agent, which can be either a water-based or oil-based substance, by means of which the normally dry inner wall 3 of the toilet bowl is cleaned and a lubricant film, such as one of silicon, is deposited. This serves to reduce sharply the likelihood of soiling of the toilet bowl in the so-called dry zone, since any deposits will tend to slide downwards because of the lubricating film.

Furthermore the liquid spray may contain a disinfectant, so that undesirable bacteria present in deposits in the toilet are largely destroyed. A decalcifying agent can also be added.

Finally, the liquid applied may contain some kind of scent or aromatic agent such as perfume, oil of ether etc., so that a scent buffer is created inside the toilet bowl before it is used. Such scents or aromatic agent should preferably be as heavy as or heavier than air, so that it does not escape from the bowl.

The dosage forced through by activation of the tube squeeze pump 14 is determined by the length and diameter of the tube running under the toilet seat 5, and preferably amounts to a volume of 0.5 to 2.0 mL.

After the toilet is used, when the user gets up from the toilet seat, the tube squeeze pump 14 is released, so that, again due to the effect of the non-return valves 7 and 17, liquid from the container 6 is sucked into the feed line 12, 14, 16. In order for the reed line to be returned essentially to its original shape after every use, the liquid feed line 12, 14, 16 should preferably be made of a silicon material, for which, of course, any plastic material that possesses sufficient properties of resiliency and yet has sufficient resistance to the chemicals and oils that are present can be used.

On the contrary, the rigid vertical pipe 12' inside the container 6 should preferably be made of a stiffened or plasticized material, so that the positioning of its open lower end in the container remains as much as possible at the lowest point of the container. Especially suitable materials for this purpose are polypropylene, polyethylene or any other plastic that has sufficient resistance to the chemicals or oils used.

The composition of the liquid in the container 6 is determined according to the needs and demands that may be placed on such a cleansing device. Normally a water-alkaline solution with a variable proportion of disinfectant and cleansing agent is used, with the addition of relatively small quantities of aroma or scent, such as oil of ether for example. Other materials such as a decalcifier or enzyme can also be used, however.

The liquid can of course be replaced by a powdered material, but in this case the device according to the invention must be adapted in its construction so as to be able to dispense a powdered material. For example, a spray nozzle intended for liquids would not be used in this case, but rather a dispenser designed for dry materials. It can also be advantageous, when using powdered materials, to replace the above described squeeze pump with some other means of ejection, such as a pressurizing device that is functionally connected with the reservoir.

In such a case, through the pressure of a person sitting on the ring, or the interruption or release of a photoelectric beam, an electrical impulse can be applied to a pressure cartridge, which in turn builds up a slight pressure in the reservoir, so that the desired dosage of powder is released inside the toilet bowl from the dispenser. This pressure build-up can however also be triggered manually by the user himself, by for example pressing on a button or activating a pedal.

The entire device is designed so as to assure it the widest possible application for equipping existing toilet installations, as well as the flexibility to dispense any kind of material that may be required for toilet maintenance. In addition, the reservoir 6 is removably plugged into the feed line 12 in such a way that the container 6 can be exchanged at any time. Of course it is also possible to fill the reservoir 6 up again from a larger refill container. The feed line hose 12, 14, and 16 is also designed so that it can be replaced from time to time.

Again, the convenient arrangement of the covering 10 or 10' on the toilet bowl 1 means that the whole device can be removed, eg. for cleaning, or the device can take the form of a so-called one-way or disposable device that can be completely replaced from time to time.

Figure 5:
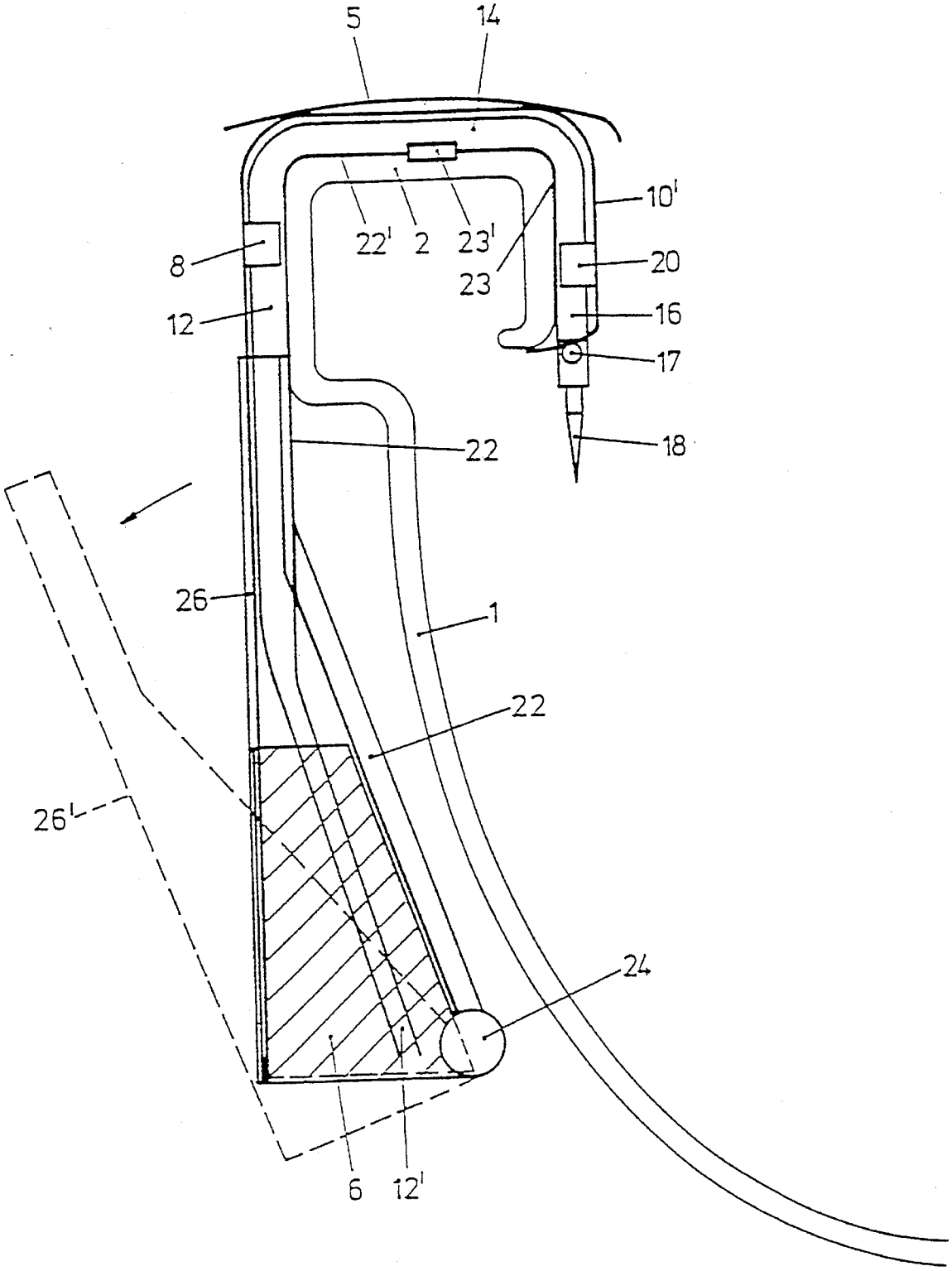
FIG. 5 is a cross-section of a further embodiment in accordance with the invention, encompassing a housing that can be tipped open and that holds an exchangeable reservoir.

FIG. 5 shows, again in cross-section, a preferred application variant of a device in accordance with the invention, corresponding essentially to that shown in FIG. 1, except that here a housing is fitted on the outside of the bowl, affixed for example on the rim of the bowl by a clamp 22' with a mounting plate 23. Using an adjustable clamp 23', the mounting of this housing 22 with its mounting plate 23 can be adjusted to the width of the bowl rim.

The housing 22 also has at its lower end a hinged connection 24 with a cover 26, which is arranged over the housing 22 and covers it. Within the housing 22, and sealed off from the outside by the covering 26, a reservoir 6 is arranged, into which, in like fashion to FIG. 1, a preferably rigid portion of the feed line 12' extends, to suck up the cleansing or disinfecting agent.

Should the reservoir run dry, the covering 26 (shown in FIG. 5 in dotted lines and indicated as 26') can be tipped outwards, so that the reservoir can be removed from the rigid housing 22. The reservoir can then either be refilled or replaced with a new container, which is inserted in the housing 22, and the covering 26 is again placed over the rigid housing.

If so desired, a locking mechanism can be provided so that the reservoir cannot be removed from the device without a special key for opening it. This can be an advantage for use in public lavatories, where as is known any unsecured object is likely to be removed. It is clear from FIG. 5 that in the sealed position, it is almost impossible to lift off the device over the rim 3.

Finally it is also possible, and indeed recommended, to correct or adjust the height or thickness of the separator pads normally attached to the toilet seat where it rests on the toilet bowl rim, so that the device according to the invention can be located without hindrance in the space between the rim and the seat.

Figure 6:
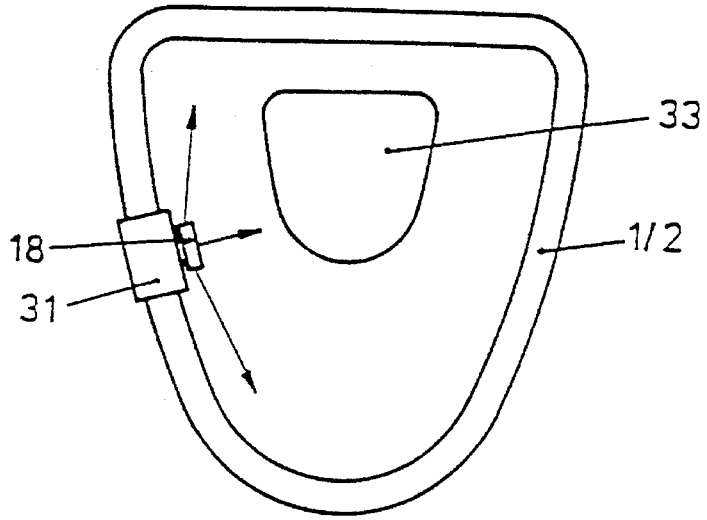
FIGS. 6*a* to 6*c* show in diagram form, from above, possible nozzle arrangements for dispensing the cleanser or disinfectant.
Figure 6:
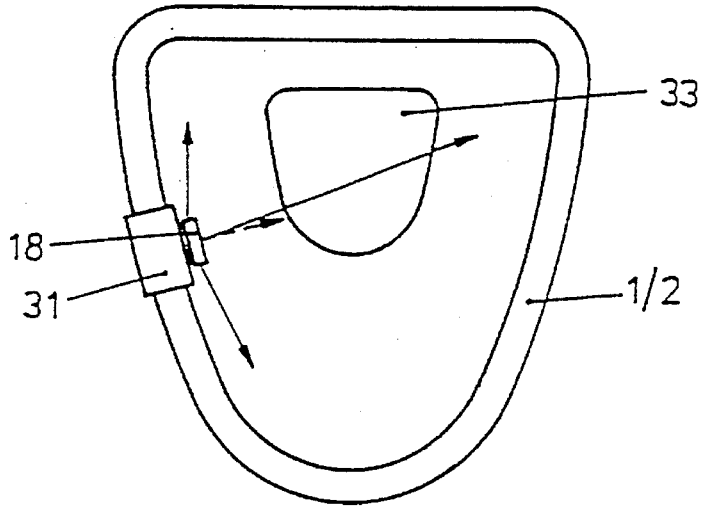
Figure 6:
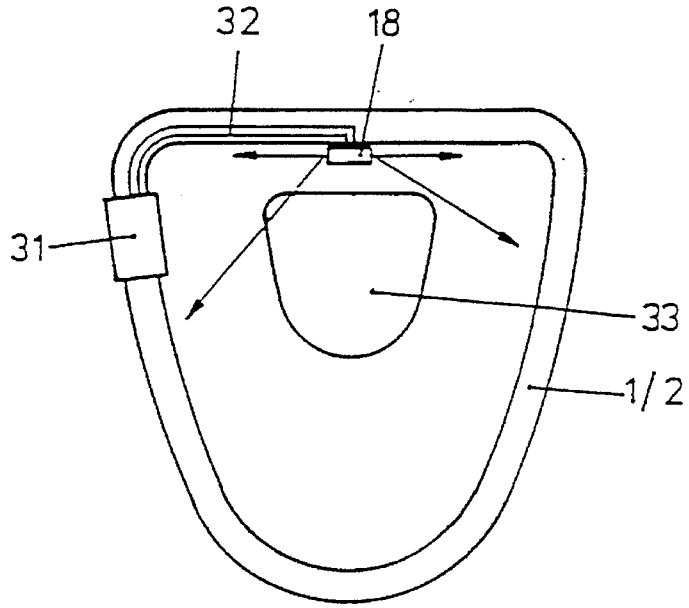

FIGS. 6*a* to 6*c* inclusive show various possible nozzle arrangements, for dispensing the cleaning or disinfecting agent in the appropriate manner. For this purpose, a device 31 designed according to the invention is shown installed on the rim 2 of a toilet bowl, with the dispenser nozzle 18 shown diagrammatically on the inside of the so-designed device. The diagram also shows the location of the outflow 33 in the middle of the toilet bowl 1.

As shown in FIG. 6*a*, the dispenser nozzle is designed so that it includes dispenser openings aimed both forwards and backwards around the rim 2 of the bowl, as well as a spray opening aligned centrally in the direction of the outflow 33.

FIG. 6*b* shows a fourth opening that permits dispensing towards the opposite side of the bowl 1.

FIG. 6*c*, finally, shows a dispenser nozzle 18 that is not directly attached to the device 31. This nozzle 18 is connected via a tube 32, and is located at the back of the rim 2 of the bowl 1, so that dispenser openings are provided on both sides around the rim 2, and in addition each opening is pointed obliquely against the two side walls of the bowl.

It is important with all dispensing nozzles that they have no openings which are directed at the genital area of the user, since disinfectants and cleaning agents are known to have an effect on sensitive skin. It is also advantageous to use a nozzle that sprinkles rather than sprays, since the flow from a spray nozzle is harder to control.

The arrangements of dispenser nozzles illustrated in FIGS. 6*a* to 6*c* are of course only examples, and many other arrangements or combinations of the three arrangements shown are possible.

The devices according to the invention shown in FIGS. 1 to 6 can of course be changed, modified or varied in any number of ways. Similarly, the cleanser or disinfectant solution used according to the invention can be modified in any number of ways, and adapted to the corresponding demands for such a cleaning fluid.

In general, the invention is suitable for dispensing any material or agent that is intended for use in toilet maintenance. In addition, any installation and any container can be used as the dispenser and reservoir as long as they are suitable for dispensing and storing the above-mentioned materials in or on a toilet bowl.

The essential feature of the invention is that a small amount of a cleansing or disinfecting agent or a scent is dispensed into the inside of a toilet bowl from a reservoir through a propulsion device located underneath the toilet seat, before the toilet is used. The dispensing or releasing process is triggered preferably by the action of a weight on the toilet seat, for example by the pressure exerted by a toilet user.

The dispensing action can also be triggered however in any way desired, such as through a photoelectric beam, an electrical switch or manually by activating a button or pedal.

I claim:

1. Device for dispensing a substance containing at least one of a disinfectant, a cleaning agent and a scent into a toilet bowl, the toilet bowl having a rim, an interior and a toilet seat, the device comprising:

a reservoir for storing the substance, the reservoir having at least one suspension member located on or outside the rim of the toilet bowl for mounting the reservoir on the toilet bowl;

a feed line extending from the reservoir, passing over the rim of the bowl and into the interior of the bowl for delivering the substance from the reservoir to the interior of the bowl;

a dispenser fitted to the feed line in the interior of the bowl for dispensing a fixed amount of the substance into the interior of the bowl;

an activator formed by an intermediate portion of the feed line that extends between the rim and the toilet seat, the intermediate portion of the feed line being filled with a desired amount of the substance so as to support the toilet seat on the intermediate portion of the feed line, and the activator being operated by a user of the toilet to dispense a given amount of the substance; and at least one non-return valve located within the feed line to prevent the substance to be dispensed from flowing backwards into the reservoir and for causing at least the intermediate portion of the feed line to be refilled with the substance after the fixed amount of the substance has been dispensed in the toilet bowl.

2. Device in accordance with claim 1, wherein the substance is a liquid and the reservoir comprises a liquid container for holding the liquid;

the feed line comprises a liquid-conducting feed line;

the dispenser includes a nozzle for spraying a given amount of the liquid into the interior of the bowl;

and the activator has the non-return valve connected thereto and is oriented in such a way that the liquid flows only toward the dispenser, the activator being located underneath the toilet seat such that the activator is activated by an activating pressure exerted on the toilet seat.

3. Device in accordance with claim 1, further comprising one of a cover and a mounting plate arranged to hold the device in place on the toilet bowl, the one of the cover and mounting plate being fastened to the bowl and adjustable to fit over a width of the rim of the bowl, in such a way that, the device can be removably fitted onto the bowl.

4. Device in accordance with claim 1, wherein the activator is located on the toilet seat in such a way that when a user sits down on the seat the activator is triggered.

5. Device in accordance with claim 1, wherein the reservoir is removably connected with the feed line in such a way that the reservoir can be sealed to the device.

6. Device in accordance with claim 1, characterized in that the dispenser comprises at least one nozzle head with several dispensing nozzles.

7. Device in accordance with claim 1, wherein the at least one non-return valve is a first non-return valve and located within the feed line at a location between the intermediate portion of the feed line and the dispenser, the device further comprising a second non-return valve located between the reservoir and the intermediate portion of the feed line.

8. Device in accordance with claim 7, wherein the first and second non-return valves are arranged to cooperate to force the substance into the toilet bowl when pressure is applied to the intermediate portion of the feed line and to restore the desired amount of the substance to the feed line after pressure is removed from the intermediate portion of the feed line.

9. Device in accordance with claim 2, wherein the activating pressure is removed from the toilet seat, the at least one non-return valve restores the intermediate portion of the feed line to a shape that is substantially the same as a shape of the intermediate portion of the feed line before the activating pressure was applied.

10. The device of claim 1, wherein the intermediate portion of the feed line and the at least one dispenser cooperate to dispense only one dose of the substance upon activation of the activator.

11. The device of claim 10, wherein the only one dose of the substance is equal to about 0.5 to 2.0 ml of the substance.

12. The device of claim 1, wherein the given amount of the substance supplied by the applicator depends on a length and a diameter of the intermediate portion of the feed line.

13. Device in accordance with claim 1, wherein the substance is a liquid containing a scent, the scent being as heavy or slightly heavier than air to form a scent buffer within the bowl.

14. Device in accordance with claim 1, wherein the activator, the dispenser, and the feed line cooperate to release the fixed amount of substance into the interior of the bowl before the toilet bowl is used.

15. Device in accordance with claim 1, wherein the substance is a liquid which forms a lubricating film in the interior of the toilet bowl when the substance is released into the toilet bowl.

16. Device in accordance with claim 1, wherein the substance comprises a scent containing liquid which contains at least one of a disinfectant, a decalcifying agent and a cleanser.

* * * * *